United States Patent [19]

Cahuzac

[11] 4,393,669

[45] Jul. 19, 1983

[54] AUTOMATIC LACING METHOD AND APPARATUS FOR MAKING PIECES WITH MULTIDIRECTIONAL WOVEN REINFORCEMENT

[75] Inventor: Georges J. J. Cahuzac, Le Bouscat, France

[73] Assignee: Societe Nationale Industrielle Aerospatiale, Paris, France

[21] Appl. No.: 228,970

[22] Filed: Jan. 27, 1981

[30] Foreign Application Priority Data

Aug. 11, 1980 [FR] France ..... 80 17666

[51] Int. Cl.[3] ..... D04B 9/44; D03D 41/00

[52] U.S. Cl. ..... 66/13; 139/11

[58] Field of Search ..... 66/11, 10, 13; 139/11, 139/22, 14

[56] References Cited

U.S. PATENT DOCUMENTS 4,183,232 1/1980 Banos et al. ..... 66/11

*Primary Examiner*—Ronald Feldbaum

*Attorney, Agent, or Firm*—Murray Schaffer

[57] ABSTRACT

The invention relates to the manufacture of woven pieces made by multidirectional weaving. A woven piece comprises, along one of the directions of weaving, temporary vertical rods which must be replaced by yarns joined to form a strand. The apparatus comprises to this end an upper assembly for detecting the position of the rods of the piece, rotating step by step, and actuating a needle with opening eye which, on descending through the woven piece, chases the rods one by one and hooks, in a lower assembly, a loop of the lacing strand and returns it into the woven piece in place of the chase rod.

18 Claims, 12 Drawing Figures

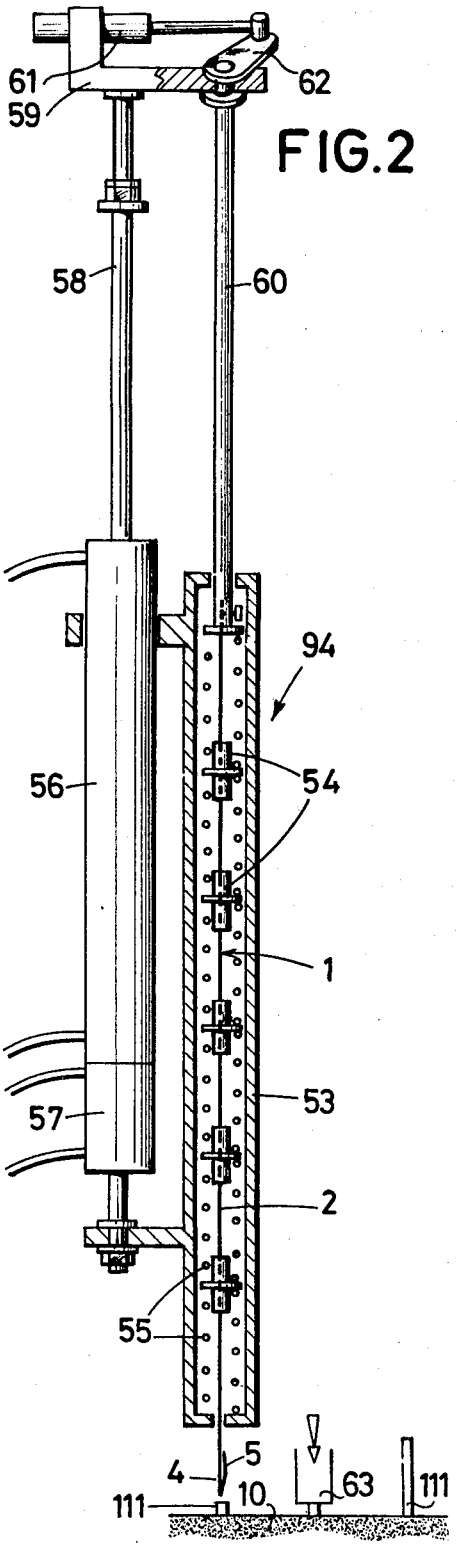
FIG.2
FIG.3
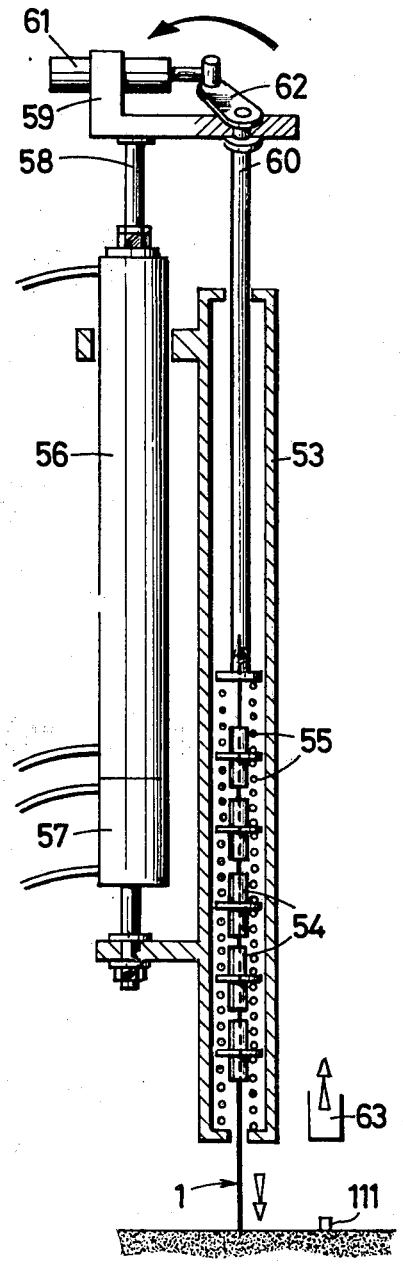

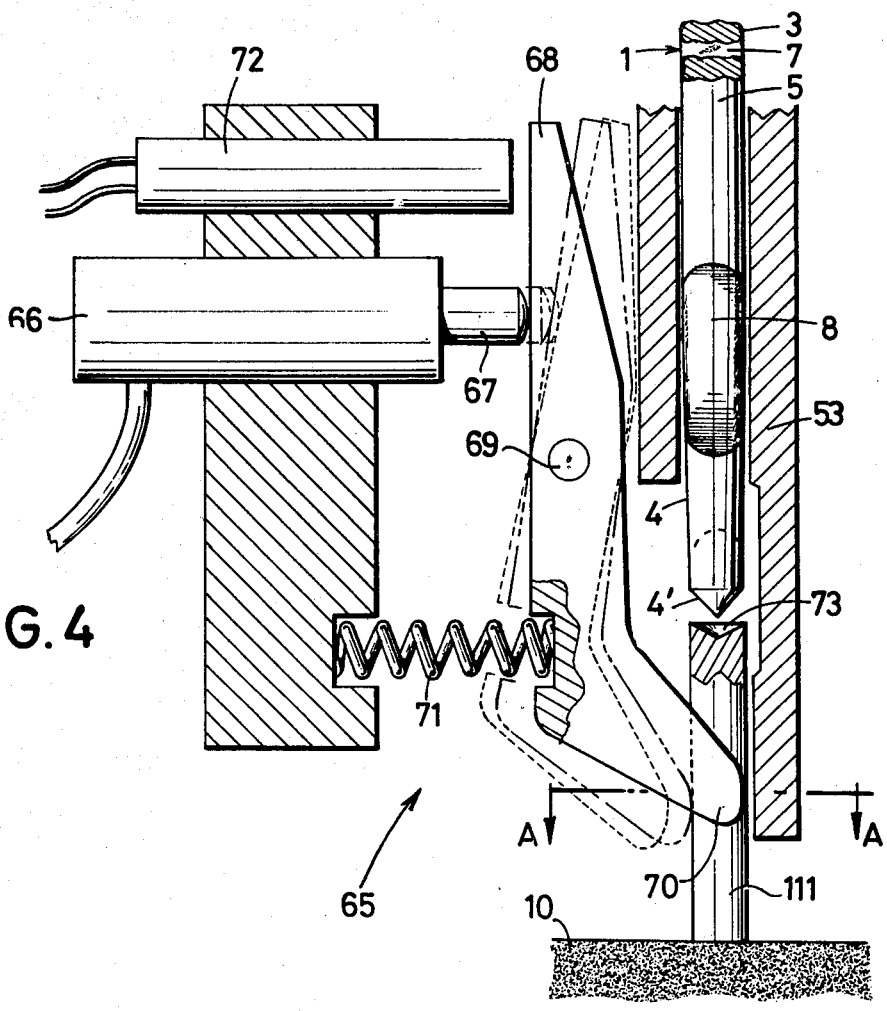
FIG. 4
FIG. 5
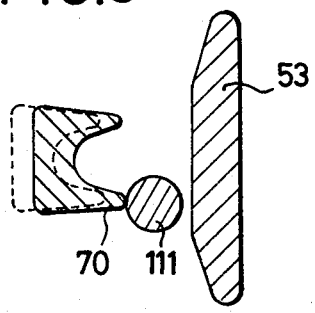
FIG. 6
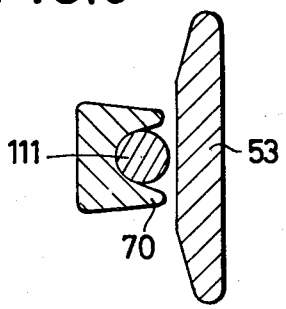

1
2
3
4
4'
5
6
7
8
11
14
14a
18
92

AUTOMATIC LACING METHOD AND APPARATUS FOR MAKING PIECES WITH MULTIDIRECTIONAL WOVEN REINFORCEMENT

The present invention relates to a automatic lacing method and apparatus for making pieces with multidirectional woven reinforcement. These pieces are obtained from a reinforcement manufactured by multidirectional weaving then impregnated with an appropriate binding agent so as to be able to withstand very high mechanical and thermal stresses, such as for example nozzles, radioelectric antenna windows, turbine vanes, nose cones of re-entry bodies, armour platings, brake discs, etc.

In the majority of the processes and machines for multidirectional weaving of reinforcements of simple or complex form, at least one direction is materialised by a network of relatively rigid rods. Thus, U.S. Pat. No. 3,904,464 describes a process for manufacturing a three-direction block in which the vertical direction is formed by rigid rods. French Pat. No. 73 14956, in the name of present applicants, also describes a process for making hollow reinforcements of revolution consisting in simultaneously depositing, via a stitching head, circumferential and radial yarns through a network of relatively rigid rods. Similarly, French Pat. No. 74 24243 describes a process for making a composite with three-dimensional reinforcement, in which all the elements of the interlaced bundles are constituted by rigid elements. Applicant's French patent application No. 77 18831, to which U.S. Pat. No. 4,183,232 corresponds, describes a a process for making woven hollow reinforcements of revolution, which may offer a complex cylindro-conical form. This process consists in effecting a three-dimensional weaving by depositing in helical layers circumferential yarns and radial yarns woven at a fixed point in front of which move rods rotated about the imaginery axis of the reinforcement of revolution.

The rods used according to these patents and patent application are constituted by a mixture of fibres of any nature and of a polymerised resin. These rods are therefore consumed in the manufacture of each reinforcement, therefore of each piece. They must be manufactured prior to production of each reinforcement. This manufacture is expensive and it is therefore advantageous to replace these rods by metal rods which may be used again. Up to the present time, these temporary rods were replaced by yarn by hand. Now, the operation is not only delicate, but also very expensive.

To overcome these various drawbacks, the present invention proposes a method for automatically lacing reinforcements or woven pieces made by multidirectional weaving and composed of filiform textile elements disposed in several directions, one of the weaving directions being initially materialised by temporary rigid rods which have to be replaced, in the course of lacing operations, by filiform textile elements such as yarns or strands. This method is characterised in that it consists in passing a needle through the woven piece, which needle simultaneously pushes a preselected rigid rod outwardly and chases it from the woven piece, in causing the needle to grip a textile element previously formed in a loop and is causing the needle, provided with the textile element thus gripped, to pass through the woven piece in the opposite direction, said textile element thus gripped occupying the space vacated by the previously chased rigid rod, and in disengaging the needle from the woven piece, then in releasing it from the textile element. The needle used is preferably a needle with opening eye, of which the eye, which is normally closed, may be opened to allow the textile element to be gripped by the needle. Such a needle forms the subject matter of a co-pending patent application.

The rigid rods are advantageously selected successively by step by step displacement of the woven piece, said rods arriving one by one beneath the needle.

It is appropriate to form the loop with the textile lacing element at the same time as the needle passes through the woven piece, pushing the rod to be chased.

The needle is preferably pivoted on itself through 90° when, after having passed through the woven piece, its head emerges therefrom, the latter than being suitably oriented to hook the loop of the textile element, then the needle is returned to its initial position by pivoting in the opposite directions, whilst it accomplishes its return stroke.

When the rigid rods used in the manufacture of the woven piece initially pass beyond a certain length of the surface of the woven piece, they are returned substantially to the level of said surface before being pushed by the needle. Said rigid rods are preferably chased by the lacing needle out of the woven piece so that they remain in positioning grids of the weaving apparatus to serve for weaving the following piece.

The invention also relates to an apparatus for carrying out the above-defined process. This apparatus comprises a mechanism for advancing the woven piece step by step in a direction perpendicular to that of the rigid rods which it comprises, and two stationary assemblies placed on either side of the woven piece in the direction of the rigid rods, namely an upper assembly comprising a sub-assembly for detecting the position of the rods and a sub-assembly for actuating and guiding a lacing needle with opening eye which passes through the woven piece, chasing the rods one by one and, after having picked up the textile element, returns bringing said textile element into the place vacated by each chased rod, and a lower assembly comprising a sub-assembly for forming, by means of a mobile member, a loop of the textile element adapted to be gripped by the needle with opening eye, and a sub-assembly for presenting the textile element alternately to said mobile member and to said needle, and a sub-assembly for opening the eye of the needle.

In a preferred embodiment, the sub-assembly for detecting the position of the rods essentially comprises a pivoting fork which is controlled to be applied on each rod coming beneath the needle, when the rod comes exactly in line with the needle, this rod is embraced by the two prongs of the fork, which then stops pivoting and controls the stop of the advance of the woven piece.

The actuating and guiding sub-assembly preferably comprises jacks for actuating the needle in longitudinal translation and in rotation on itself and a column guiding said needle and arranged to avoid buckling thereof.

The upper assembly may further include a sub-assembly for leveling the rods, which drives each rod virtually level with the surface of the woven piece before it comes beneath the needle to be chased thereby.

The loop forming sub-assembly advantageously comprises a hook animated by a jack in a direction perpendicular to the axis of the needle, at the same time as the needle descends through the woven piece.

A preferred embodiment of the sub-assembly for presenting the textile element is characterised in that it comprises a presenting device guiding said textile element and pivoting under the action of a jack so as to bring the textile element firstly in mesh with the mobile loop forming member, then against the needle to cause it to penetrate in the open eye of said needle, said textile element then being gripped and driven through the woven piece as the needle rises. The said presenting device advantageously comprises a plurality of convergent guide channels adapted to receive a plurality of fibres or filaments and to connect them at its outlet to form the textile element.

As to the sub-assembly for opening the eye of the needle, it preferably comprises a piece offering a passage in which the head of the needle penetrates at the end of its downward stroke and where it encounters a ramp which pushes it laterally to towards a knife, the latter then penetrating in the eye of the needle, ensuring opening thereof. This sub-assembly is appropriately animated radially by small movements ensuring its retraction to allow the chased rods to pass and its return to receive the needle.

The invention will be more readily understood on reading the following description with reference to the accompanying drawings, in which:

FIGS. 2 and 3 show, on a larger scale, in elevation with partial section, the sub-assembly for actuating and guiding the needle, in two different functional situations, respectively.

FIG. 4 shows in section, through a radial plane, the sub-assembly for detecting the position of the rigid rods to be replaced by a textile element.

FIGS. 5 and 6 show a section along line A—A of the sub-assembly of FIG. 4, in two successive functional situations.

Figure 1:
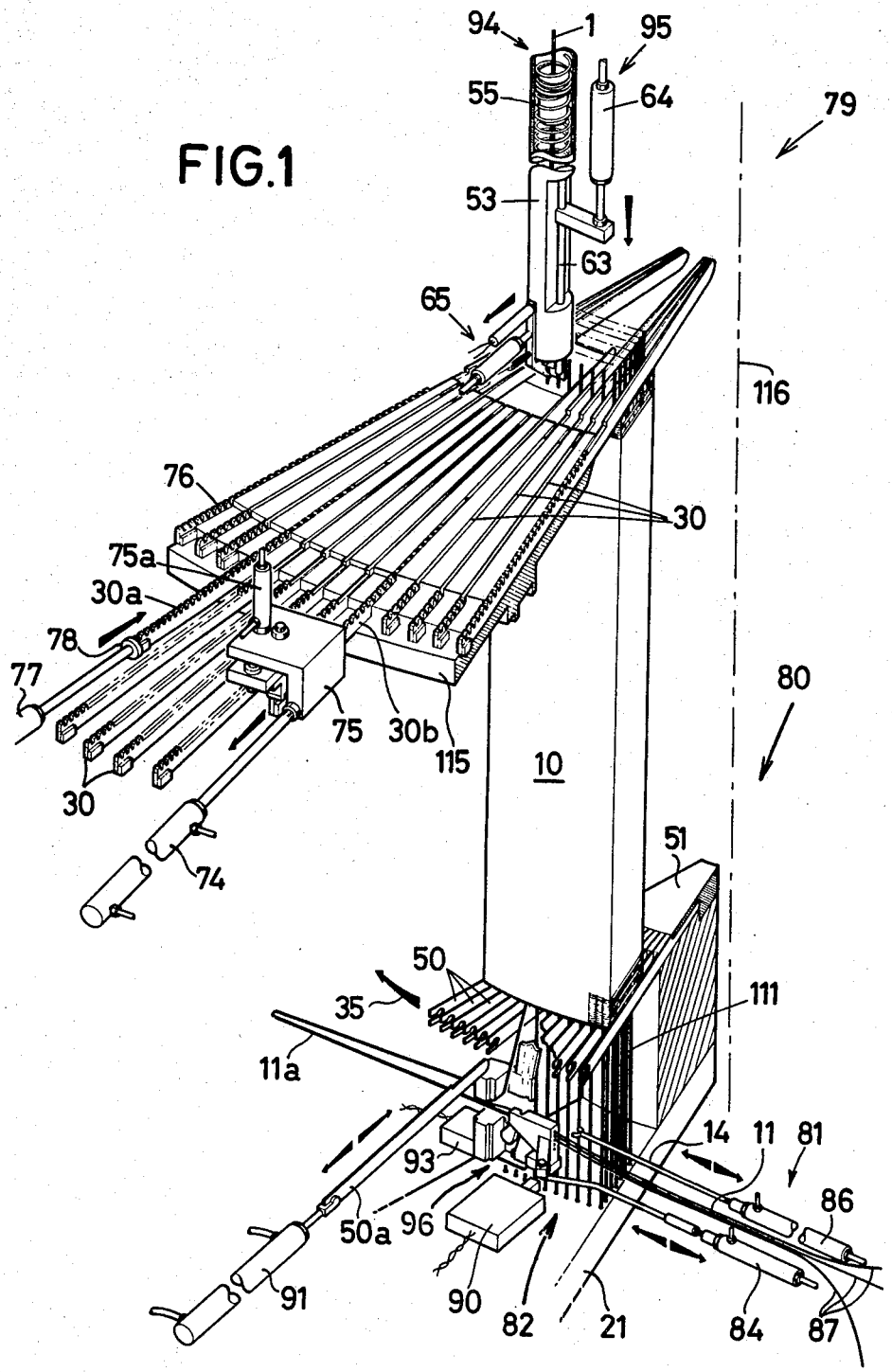
FIG. 1 shows in perspective a lacing apparatus according to the invention.

FIGS. 8*a* to 8*e* schematically illustrate the functioning of the needle with opening eye.

Referring now to the drawings, the piece to be laced is, in the present embodiment, in the form of a reinforcement of revolution 10 (of which only a sector has been shown) woven according to the process and with the apparatus described in French patent application No. 77 18831. This reinforcement (FIG. 1) is constituted by a network of vertical rods 111 of axis 116 provided with woven yarns during the so-called weaving operation. These rods define circumferential and radial "corridors" which are filled with so-called circumferential and radial yarns, which are tamped by fingers 30 disposed in a ring around the axis 116. The lower end of the rods 111 passes in one or more grids such as grid 21 where they may circulate freely. The woven piece is defined and supported in its lower part by a set of blades 50 held by fitting in an inner grooved plate 51 and, in its upper part, by a another set of blades or fingers 30 having served for weaving, retained by an outer grooved plate 115. The whole is designed so that, at the beginning of the weaving operation, the lower blades 50 may come into contact with the upper fingers 30. All these elements may rotate about the vertical axis of rotation 116 of the piece.

Above the rods 111 is disposed an assembly 79 comprising a long needle 1 (of the order of 1 meter long) held in a fixed tubular frame 53 where it may slide, its stroke being sufficient to enable it to pass through the woven piece 10.

The tube 53 is arranged to avoid buckling of the needle 1; it contains (FIG. 2) crosspieces 54 interposed between helical springs 55. Two jacks ensure the descent and rise of the needle 1; a main jack 56 which, on descent, controls the lowering of the needle 1 through the woven piece 10 until its head 4 appears beyond the lower face of the piece 10 (position shown in FIG. 3) and a secondary jack 57 which ensures the final stroke of the needle 1 where the latter grips the yarns adapted to replace the rods 111.

The jacks 56 and 57 are mounted back to back, as shown. The rod 58 of the jack 56 carries a support 59 connected to the top of the needle 1 by a tubular rod 60. On this support is mounted a small jack 61 capable of rotating the rod 60 and consequently the needle 1, due to a crank 62, as may be seen in FIG. 3. The elements 56 to 62 have not been shown in FIG. 1.

The arrangement which has just been described constitutes a sub-assembly 94 for actuating and guiding the needle 1.

The first function of the needle 1 is to eliminate the rods 111 from the woven piece 10, by chasing them one by one during its successive descents through the woven piece. To this end, the rods 111 of each circumferential layer centred on the axis 116 are brought one after the other in line with the needle 1 in high position, by step by step rotation of the woven piece 10 about the axis 116 by means of a mechanism (not shown).

The rods 111 which usually pass beyond the top face of the piece 10 once weaving is terminated, are each previously driven by a push member 63 moved by a jack 64 (sub-assembly 95 for leveling the rods 111) so as to bring their end virtually level with the top face of the piece 10.

It is then important that each rod 111 comes into position exactly beneath the needle 1, so that the latter meets it on descending and can chase it. A sub-assembly 65 for detecting the position of the rods 111 is provided to this end. The latter comprises (FIG. 4) a single-acting jack 66 of which the rod 67 abuts on a lever 68 pivoting about a horizontal pin 69 and carrying at its lower end a fork 70 located in the radial plane containing the needle 1, so as to maintain said fork in its rest position (shown in dotted lines) where it is spaced apart from the spot where the rods 111 pass. When a rod 111 arrives near the needle 1, the jack 66 is rendered inactive. The lever 68 then pivots under the action of a spring 71 which acts by pushing the fork 70 towards the rod 111. The latter is then generally poorly positioned and one of the prongs of the fork 70 meets it (FIG. 5), the lever 68 stopping in the position shown in dashed and dotted lines in FIG. 4. The woven piece 10 continues to be rotated until the hollow of the fork 70 embraces the rod 111 (FIG. 6). The lever 68 then pivots completely, taking the position shown in solid lines in FIG. 4, which is detected by a detector 72, for example a magnetic proximity detector, which controls the stop of the rotation of the woven piece 10. The rod 111 selected is then positioned exactly beneath the needle 1 and in line therewith and said needle, on descending, will push it downwardly by its head 4 provided with a point 4' which is housed in a corresponding cavity 73 provided at the end of each of the rods 111. Of course, a body of the jack 66, the pin 69 of the lever 68 and the detector 72 are connected to the upper frame 53 of the upper assembly 79.

The fingers 30, which served to tamp the woven piece in the course of being made, rest thereon when it is terminated. Those which arrive, during the step by step rotation of the woven piece 10 in the direction of arrow 35, in the region of the needle 1, must be moved away. To this end, two fixed, radially oriented jacks 74,77 are provided. The jack 74 ensures disengagement of the fingers 30 and acts via a pawled hooking device 75 controlled by a small jack 75*a*, which cooperates with a rack 76 which each of the fingers 30 comprises over part of its length; the jack 77 provided with a push member 78 ensures that said fingers are replaced in position, which fingers slide in the grooved plate 115 rotating with the woven piece 10. Each finger 30 arriving at a certain distance from the needle 1 is hooked by the device 75 and drawn in centrifugal direction by the jack 74. It then continues to rotate in disengaged state until it arrives in front of the jack 77 whose push member returns it into normal situation, beyond the needle 1.

The second function of the needle 1 is to hook and draw the textile element 11 inside the woven piece 10. The lower assembly 80 of the lacing apparatus corresponds to this function, said assembly, placed beneath the woven piece 10, comprising a subassembly 81 for forming a loop of the textile element 11 which is to replace the rods 111, a sub-assembly 82 for presenting the textile element 11 successively for formation of said loop and for hooking by the needle 1, and a sub-assembly 96 for opening the eye 7 of said needle.

The textile element 11 is, in the present example, a strand formed by three yarns 87 issuing from reserve bobbins (not shown) and passing over advance detectors 83 (FIG. 7) which indicate any break or immobilisation possibly affecting one or the other of said yarns and in that case stop the lacing apparatus. Said yarns penetrate in the direction of arrow 15 in convergent guide channels 13 hollowed in a presenting device 12, mobile about a pivot pin 19, which forms, with its actuating jack 84, on the rod 85 of which it is articulated, the above-mentioned presentation sub-assembly 82.

The sub-assembly 81 ensuring the formation of a loop on the strand 11, comprises a jack 86 disposed horizontally and a push member 14 actuated by this jack and provided at its end with a hook 14*a* adapted to take the strand 11 towards the left in the Figures to cause a loop 11*a* of suitable length to appear at the outlet of the presenting device 12, after correlative unwinding of the yarns 87.

The needle 1 is a needle with opening eye such as the needle described in applicant's copending patent application filed on the same day as the present application. This needle comprises a long shank 2 which is bent in its lower part 3 to form a head 4 and an elastic blade 5, presenting a thin zone 8, whose end 6 is normally applied against the shank 2, but may be moved away therefrom under the action of an opener (which will be described hereinafter) so as to open the eye 7 formed between the blade 6 and the part 3 of the needle shank.

The above-mentioned opener (FIG. 7) comprises a passage 16 made in a fixed piece 20 and offering a lateral ramp 17 which meets the head 4 of the needle 1 and which pushes it slightly to the left, this causing a knife 18, fixed on the piece 20, to penetrate in the eye 7 of the needle 1.

The sub-assembly 96 for opening the eye 7 of the needle 1, mainly comprising the opener and the guide piece 20, is mounted on a support 88 which further carries a groove 89 for guiding the needle 1 when it emerges from the woven piece 10. This support 88 may be displaced radially in a short stroke by a jack (not shown).

The different phases of operation of the apparatus given here by way of example will now be described.

In a first step, the push member 63 descends on a rod 111 to take it to the desired level, then rises into rest position; the fork 70 detects the arrival of the preceding rod 111 in alignment with the needle 1 and controls the stop of the rotation of the woven piece 10.

In the following step, the needle 1 begins to descend under the action of the jack 56, whilst the jack 66 returns the fork 70 into rest position. The needle 1, oriented as shown in FIG. 4, its eye 7 offering its orifice in radial direction, passes through the woven piece, chasing the selected rod 111, then stops when its head 4 emerges through the bottom of the woven piece 10. The rod 111, disengaged from said woven piece, continues to descend by its own impetus through the grid 21 and stops on a horizontal plate (not shown in the drawings), its top end passing slightly beyond the grid 21 (FIG. 1) (the result of this arrangement is that the rods 111 chased from the woven piece 10 do not escape the grid 21, nor the other grids (not shown), this facilitating their return into position on the weaving machine for making a new piece 10). A detector 90 detects that each rod 111 has reached the final position that has just been specified, otherwise the detector 90 controls the stop of the apparatus.

Figure 7:
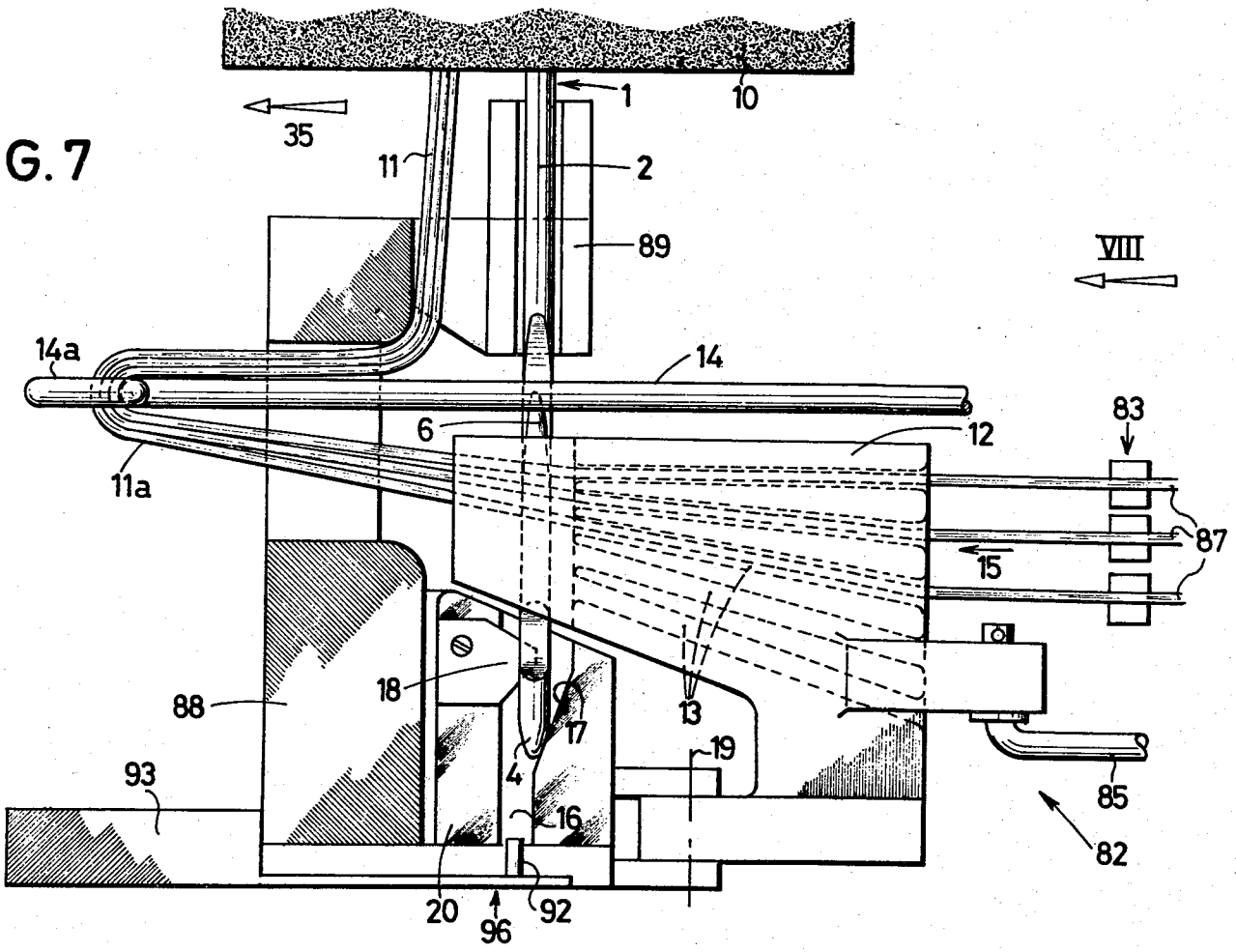
FIG. 7 shows in elevation the sub-assemblies for presenting the textile element and for opening the eye of the needle.

Whilst the needle 1 was descending, the push member formed a loop 11*a* on the strand 11 (FIG. 7). On the other hand, to avoid the blade 50*a* of the lower plate 51 located upstream of the needle 1, between said needle and the strand 11 emerging from the woven piece 10, being taken up in the loop 11*a*, this blade has been hooked and temporarily extracted radially from the plate 51 by a jack 91 (FIG. 1).

Figures 8A, 8B, 8C, 8D, 8E:
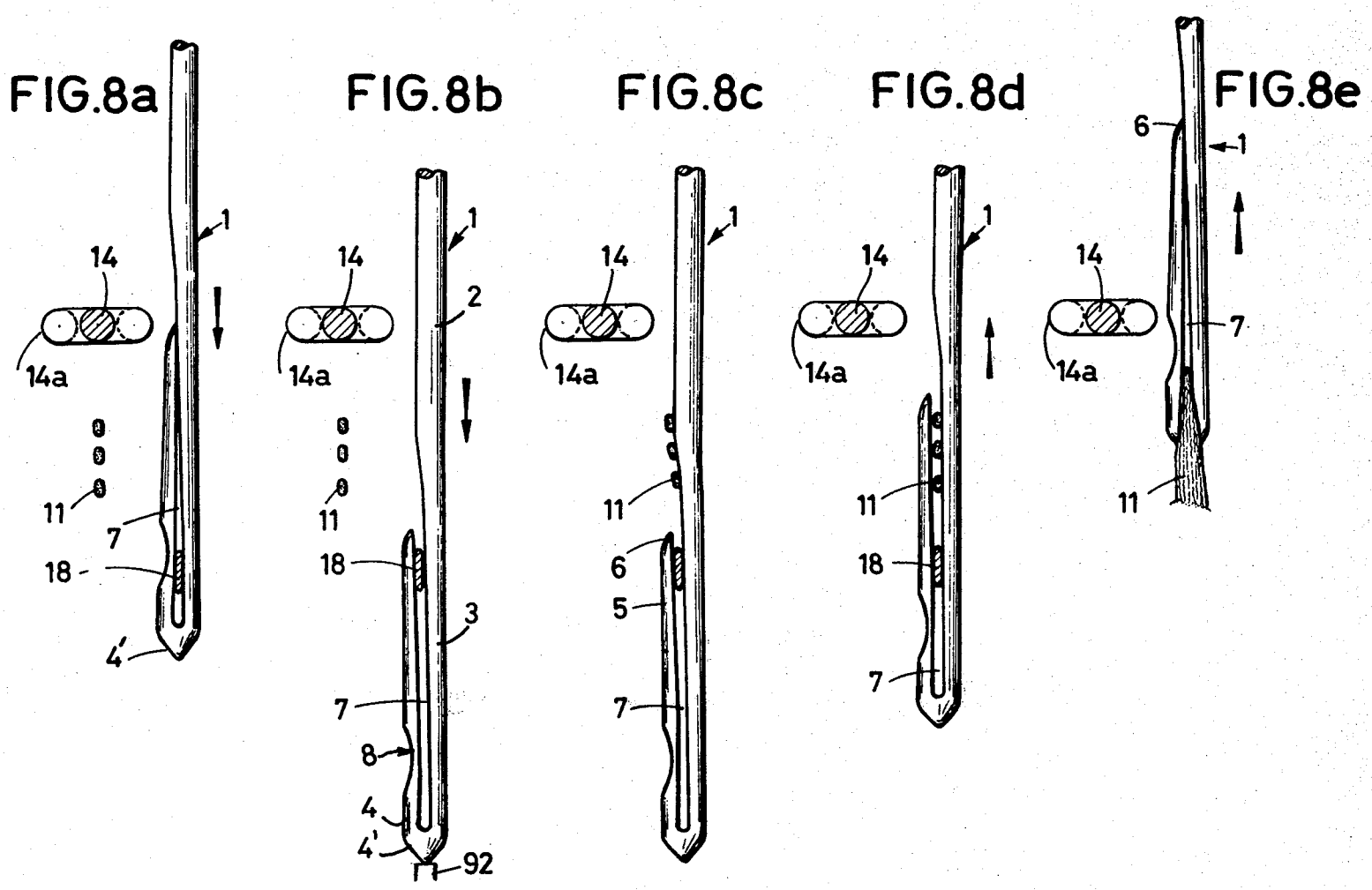

The rod 111 having left the needle 1, the latter pivots through 90° under the action of the jack 61 (FIG. 3) to take the position shown in FIG. 7. The piece 88 moves towards axis 116 so that the groove 89 and the passage 16 of the piece 20, previously eclipsed to give free passage to the rod 111, are in the axis of the needle 1. The needle 1 continues to descend under the action of the jack 57, penetrates in the passage 16, meets the ramp 17 and its eye 7 is opened by the knife 18 (FIGS. 7 and 8*a*). Finally, it meets the actuator 92 of a contactor 93 which records the arrival of the needle at the end of stroke, the eye of which is then completely open (FIG. 8*b*) and allows the following sequence.

The presenting device 12 pivots under the action of the jack 84 and presents the strand 11 against the needle 1, above the end 6 of its blade 5 (FIG. 8*c*). The press member 14 withdraws and releases the loop 11*a*. The needle begins to rise again, grips the strand 11 (FIGS. 8*d* and 8*e*) and pivots again through 90°, in the direction opposite the pivoting effected on descent, as soon as its head 4 has passed the lower assembly 80, continuing its rise and taking the strand 11 in its closed eye 7 through the woven piece 10, to take the place of the chased rod 111, whilst the loops 11*a* is reabsorbed.

When the needle 1 arrives at the end of rise, the lower blade 50*a* is returned into position, as well as, on the upper plate 115, the first withdrawn finger 30*a*, whilst a new finger 30*b* upstream of the push member 63, is extracted (FIG. 1).

The woven piece 10 then rotates by one step, with the plates 115 and 51, the fingers 30, blades 50 and the grid 21, so as to present the following rod 111 in the axis of the needle 1. A new lacing cycle may then be carried out. At the top of the piece 10, the strand 11 is either broken at each step, or arranged in chain stitch by the needle 1.

The different circumferential rows of rods 111 are treated successively by radial displacement of the assemblies 79 and 80.

What is claimed is:

1. Method for automatically lacing reinforcements or woven pieces made by multidirectional weaving and composed of filiform textile elements disposed in several directions, one of the directions of weaving being initially materialised by temporary rigid rods which have to be replaced, in the course of lacing operations, by filiform textile elements, this method comprising the following steps of:

passing a needle through the woven piece, which needle simultaneously pushes a preselected rigid rod outwardly and chases it from the woven piece, causing the needle to grip a textile element previously formed as a loop and causing the needle, provided with the textile element thus gripped, to pass through the woven piece in the opposite direction, said textile element thus gripped occupying the space vacated by the previously chased rigid rod, disengaging the needle from the woven piece, and releasing it from the textile element.

2. The method of claim 1, wherein the needle used is a needle with opening eye, of which the eye, which is normally closed, may be opened to allow the textile element to be gripped by the needle.

3. The method of claim 1, wherein the rigid rods are selected successively by step by step displacement of the woven piece, said rods coming one by one beneath the needle.

4. The method of claim 1, wherein the loop is formed with the textile lacing element at the same time as the needle passes through the woven piece, pushing the rod to be chased.

5. The method of claim 1, wherein the needle is pivoted on itself through 90° when, after having passed through the woven piece, its head emerges therefrom, the latter than being suitably oriented to hook the loop of the textile element, then the needle is returned to its initial position by pivoting in the opposite direction, whilst it accomplishes its return stroke.

6. The method of claim 1, wherein the rigid rods used in the manufacture of the woven piece, initially passing beyond a certain length of the surface of the woven piece, are returned substantially to the level of said surface before being pushed by the needle.

7. The method of claim 1, wherein the rigid rods used in making the woven piece are chased by the lacing needle out of the woven piece so that they remain in positioning grids of the weaving apparatus to serve for weaving the following piece.

8. Apparatus for automatically lacing a reinforcement or woven piece formed by the multidirectional weaving of filiform textile elements on a plurality of rigid rods, a mechanism for advancing the woven piece step by step in a direction perpendicular to that of the rigid rods, two stationary assemblies placed on either side of the woven piece in the direction of the rigid rods, namely an upper assembly comprising a sub-assembly for detecting the position of the rods and a sub-assembly for actuating and guiding a lacing needle, a lacing needle having a normally closed opening eye, said lacing needle being operable by said upper sub-assembly to pass through the woven piece, chasing the rods one by one and, picking up a textile element at the end of said pass and return, bringing said textile element into the place vacated by each chased rod, and a lower assembly comprising a sub-assembly having a mobile member for forming, a loop of the textile element by the needle and a sub-assembly for presenting the textile element alternately to said mobile member and to lacing said needle, and a sub-assembly for opening the eye of the needle for said needle to grip the loop of the textile element.

9. The apparatus of claim 8, wherein the sub-assembly for detecting the position of the rods essentially comprises a pivoting fork which is controlled to be applied on each rod coming beneath the needle, whilst, when the rod comes exactly in line with the needle, this rod is embraced by the two prongs of the fork, which then stops pivoting and controls the stop of the advance of the woven piece.

10. The apparatus of claim 8, wherein the actuating and guiding sub-assembly comprises jacks for actuating the needle in longitudinal translation and in rotation on itself and a column guiding said needle, arranged to avoid buckling thereof.

11. The apparatus of claim 8, wherein the upper assembly further comprises a sub-assembly for leveling the rods, which drives each rod virtually level with the surface of the woven piece before it comes beneath the needle to be chased thereby.

12. The apparatus of claim 8, wherein the loop forming sub-assembly comprises a hook animated by a jack in a direction perpendicular to the axis of the needle, at the same time as the needle descends through the woven piece.

13. The apparatus of claim 8, wherein the sub-assembly for presenting the textile element comprises a presenting device guiding said textile element and pivoting under the action of a jack so as to bring the textile element firstly in mesh with the mobile loop forming member, then against the needle to cause it to penetrate in the open eye of said needle, said textile element then being gripped and driven through the woven piece as the needle rises.

14. The apparatus of claim 13, wherein the presenting device comprises a plurality of convergent guide channels adapted to receive a plurality of fibres or filaments and to connect them at its outlet to form the textile element.

15. The apparatus of claim 8, wherein the sub-assembly for opening the eye of the needle comprises a piece offering a passage in which the head of the needle penetrates at the end of its downward stroke and where it encounters a ramp which pushes it laterally towards a knife, the latter then penetrating in the eye of the needle, ensuring opening thereof.

16. The apparatus of claim 8, wherein the sub-assembly for opening the eye of the needle is animated radially by small movements ensuring its retraction to allow the chased rod to pass and its return to receive the needle.

17. The apparatus of claim 8, comprising safety systems constituted by a first proximity detector mounted to as to enter into relation with the end of the lever carrying the pivoting fork when the two prongs of said fork embrace a rod having to be chased by the needle, and so as to control, in this case, the stop of the advance of the woven piece; second detectors detecting the advance of the yarns issuing from the reserve bobbins and adapted to form a textile element brought to replace a rod, mounted opposite said yarns so as to indicate any rupture or immobilisation affecting said yarns and, in this case, to stop the lacing apparatus; a third detector placed in the upper part of the grid so as to detect the final position of each rod chased by the needle and to control the stop of the apparatus in case of anomaly, and a contactor of which the actuator is located at the inlet of the passage of the opener and intended to record the arrival of the needle at its end of stroke and to allow the following sequence.

18. The apparatus of claim 15, wherein the sub-assembly for opening the eye of the needle is animated radially by small movements ensuring its retraction to allow the chased rod to pass and its return to receive the needle.

* * * * *